United States Patent [19]

Schulthess

[11] 4,133,920

[45] Jan. 9, 1979

[54] METHOD FOR REINFORCING THE EDGE REGION OF A PLATE FORMED OF A POROUS MATERIAL BY MEANS OF A REINFORCEMENT AGENT

[75] Inventor: Hans Schulthess, Klingnau, Switzerland

[73] Assignee: Keller & C. Aktiengesellschaft, Klingnau, Switzerland

[21] Appl. No.: 663,199

[22] Filed: Mar. 2, 1976

[30] Foreign Application Priority Data

Mar. 7, 1975 [CH] Switzerland ..... 2948/75

[51] Int. Cl.[2] ..... B05D 1/32

[52] U.S. Cl. ..... 427/282; 118/301; 118/406; 118/504; 118/505; 427/294; 427/295; 427/296; 427/297; 427/430 R; 427/440

[58] Field of Search ..... 427/282, 440, 297, 294, 427/295, 296, 430 R; 118/301, 406, 504, 505

[56] References Cited

U.S. PATENT DOCUMENTS

| | | | |
|---|---|---|---|
| 2,363,841 | 11/1944 | Duggan | 118/505 |
| 2,363,842 | 11/1944 | Duggan | 118/505 |
| 2,456,093 | 12/1948 | Sweldow | 427/296 |
| 2,740,728 | 4/1956 | Sonnabend et al. | 427/297 |
| 2,838,424 | 6/1958 | Depew et al. | 427/297 |
| 2,867,543 | 1/1959 | Braun | 427/297 |
| 3,082,115 | 3/1963 | Griffin et al. | 427/295 |
| 3,650,804 | 3/1972 | Parisi | 427/294 |
| 3,876,440 | 4/1975 | Smith et al. | 427/294 |
| 3,912,833 | 10/1975 | Becker | 427/294 |

*Primary Examiner*—Ronald H. Smith
*Assistant Examiner*—Janyce A. Bell
*Attorney, Agent, or Firm*—Karl W. Flocks

[57] ABSTRACT

A method of reinforcing an edge region of a plate formed of a porous material by means of a reinforcement agent wherein the plate is immersed in a bath containing a reinforcement agent. Air contained in the plate is withdrawn at least from one plate surface. Both plate surfaces prior to the immersion of the plate in the bath are covered so as to be protected against contact by the reinforcement agent.

5 Claims, 3 Drawing Figures

METHOD FOR REINFORCING THE EDGE REGION OF A PLATE FORMED OF A POROUS MATERIAL BY MEANS OF A REINFORCEMENT AGENT

BACKGROUND OF THE INVENTION

The present invention relates to a new and improved method of reinforcing the edge region of a plate formed of a porous material by means of a reinforcement agent.

It is known in this particular field of technology that the edges of plates formed of porous materials, such as for instance chipboard and plates formed of a mineral substance or material, such as "Vermipan," must be reinforced in order, among other things, to increase the impact resistance of the edges and to be able to thread screws and the like into the plate from the side of the edges.

With a state-of-the-art technique for edge-reinforcement wooden ledges, so-called glued borders, are applied to the plate edges. This procedure is of course associated with considerable work and therefore expensive.

Additionally, it is known to reinforce the edges of a plate by forcing-in at high pressure a reinforcement agent. Yet, this method is nonetheless associated with relatively great costs owing to the considerably great amount of equipment which is needed for the performance thereof.

SUMMARY OF THE INVENTION

Hence, it is a primary object of the present invention to provide a new and improved method of reinforcing the edge regions of a plate formed of a porous material by means of a reinforcement agent in a manner not associated with the aforementioned drawbacks and limitations of the prior art proposals.

Another and more specific object of the present invention aims at the provision of a new and improved method of the previously mentioned type by means of which it is possible to reinforce the edges in as simple and inexpensive manner as possible.

Now in order to implement these and still further objects of the invention, which will become more readily apparent as the description proceeds, the method aspects of the present invention are manifested by the features that the plate is immersed in a bath containing a reinforcement agent and at least from one plate surface of the plate the air contained therein is withdrawn. Further, both plate surfaces, prior to immersion of the plate into the bath, are protected against contact with the reinforcement agent by covering such plate surfaces.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
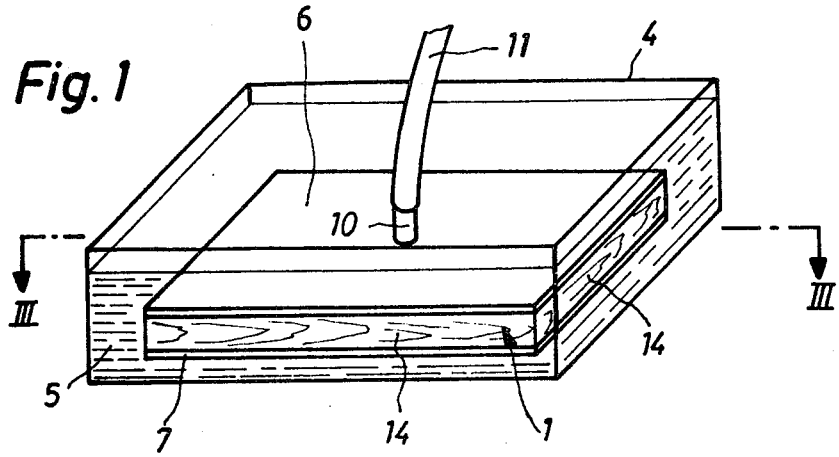
FIG. 1 schematically illustrates a plate covered at its upper face and lower face and located in a reinforcement agent-bath.
Figure 2:
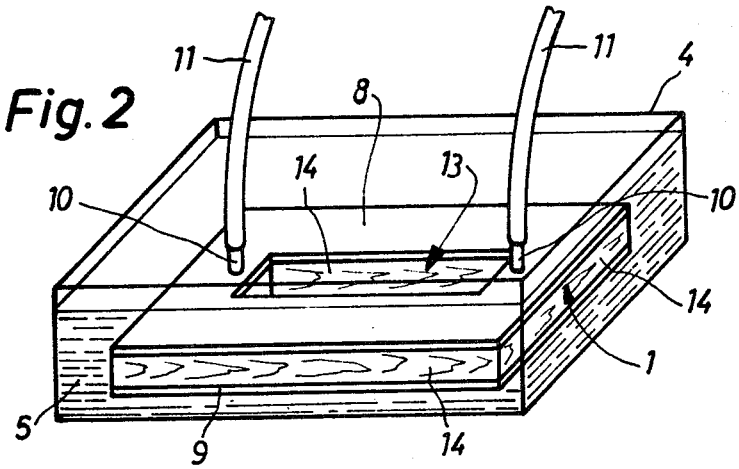
FIG. 2 illustrates the same arrangement as shown in FIG. 1, but with a plate provided with a recess.
Figure 3:
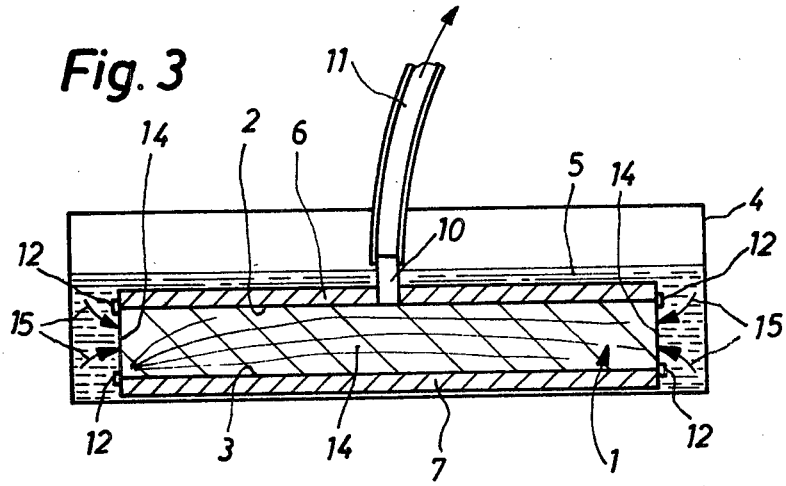
FIG. 3 is a cross-sectional view taken along the line III—III of FIG. 1.

Describing now the drawings, it is to be understood that FIGS. 1 to 3 only schematically show the components of the apparatus for the performance of the method needed to understand the underlying principles and concepts of the method aspects of this development.

Thus, the plates 1, the edge regions of which should be reinforced, are completely covered at both surfaces 2 and 3, as best seen by referring to FIG. 3, and introduced into a container or vat 4 which is open at the top and contains a suitable reinforcement agent 5. The plate 1 is completely submerged or immersed in the reinforcement agent-bath.

Covers or cover members 6, 7 (FIGS. 1 and 3) and 8, 9 (FIG. 2) respectively, are applied to both plate surfaces 2, 3 and completely cover these plate surfaces. The upper cover or cover member, such as the cover member 6 of FIG. 1 or the cover member 8 of FIG. 2, possess one or a number of connections or studs 10, each of which can be connected via a connection conduit or line 11 with a not particularly illustrated but conventional air suction installation, such as a suction pump or equivalent structure.

At the edge of the cover members 6, 7 and 8, 9 respectively, there is provided a suitable seal or closure between the relevant cover member and associated plate surface in order to prevent penetration of the reinforcement agent 5 between each cover member and the associated plate surface. In FIG. 3 this seal or closure is constituted, by way of example, by an adhesive strip 12 which extends completely about the periphery of the plate.

In the case of a plate 1 which, as in the showing of FIG. 2, has a recess 13, the cover mebmers 8, 9 likewise are provided with an appropriate recess. The previously mentioned seal or closure must then also be applied to the edge of such recess.

Now if the air suction installation is placed into operation, then the plate surface 2 (FIG. 3) is exposed to a negative pressure, resulting in withdrawal of the air contained in the porous plate 1. The reinforcement agent can penetrate into the plate 1 from the narrow sides 14, as such has been indicated in FIG. 3 by the arrows 15, by virtue of the atmospheric pressure which acts upon the surface of the reinforcement agent-bath.

At this point there will be summarized once again some of the more essential steps of the method of the invention:

(a) Both surfaces of the plate, prior to the immersion into the reinforcement agent-bath, are covered in such a manner that such surfaces cannot come into contact with the reinforcement agent and no reinforcement agent can penetrate between each cover member and the associated plate surface.

(b) The plate which has been covered in this manner is immersed or submerged in a bath consisting of a reinforcement agent or containing a reinforcement agent.

(c) At least from the side of one surface of the plate the air contained in such plate is withdrawn, and the reinforcement agent can penetrate into the plate from the regions of the plate edges.

The apparatus for the performance of the aforesaid method can possess any suitable construction. In particular, the cover members and the connections with the air suction installation can be constructed differently than illustrated in the drawings of the exemplary embodiment.

It is also possible to suck-off the air from both plate surfaces out of such plate.

The air suction action can be carried out during the entire treatment time continuously or only periodically at the plate surface or surfaces.

Instead of using a container 4 which is open at the top as described it is also possible to provide a closed pressure container in that apart from the reinforcement agent there is also provided a compressed gas exerting a pressure upon the surface of the reinforcement agent-bath which is greater than atmospheric pressure. This excess pressure can be effective during the withdrawal of air out of the plate. It is however also conceivable to alternately withdraw air from the plate and to have the excess pressure act upon the bath surface.

In the event it is desired that certain edge sections of the plate are not reinforced, then the corresponding edge section, prior to submersion of the plate into the bath, can be covered, so that at the covered locations there cannot penetrate into the plate any reinforcement agent.

As the reinforcement agent there can be employed all suitable liquid substances, such as a synthetic resin. The nature of the reinforcement agent is not crucial to the invention and suitably commercially available materials can be readily employed.

The described edge-reinforcement method can be employed for all plates which are formed of a porous material, for instance wood chipboards and plates formed of a material formed on a mineral basis such as "Vermipan", by way of example.

While there is shown and described present preferred embodiments of the invention, it is to be distinctly understood that the invention is not limited thereto, but may be otherwise variously embodied and practiced within the scope of the following claims.

Accordingly, what is claimed is:

1. A method of reinforcing an edge region of a porous plate by impregnating said edge region with a reinforcement agent, comprising the steps of:

(1) providing a porous plate having plate surfaces and a peripheral plate edge;

(2) providing a reinforcement agent-bath;

(3) covering each said plate surface completely with a covering plate, prior to immersion of the plate into the bath in order to protect the covered plate surfaces against contact with the reinforcement agent, and to seal against the entry of the reinforcement agent at the edge of each covering the intermediate space between the covering plate and the neighboring plate surface, the space between at least one covering plate and the associated plate surface being connected to an air suction means;

(4) completely immersing the plate into the bath containing the reinforcement agent;

(5) withdrawing air contained within the pores of the plate by applying vacuum from said space between said at least one covering plate and the associated plate surface, said reinforcement agent thereby penetrating and reinforcing said edge region along substantially the entire periphery thereof in a single operation.

2. The method as defined in claim 1, including the step of removing air from the plate at both plate surfaces.

3. The method as defined in claim 1, including the step of subjecting the surface of the reinforcement agent-bath to atmospheric pressure.

4. The method as defined in claim 1, including the step of subjecting the surface of the reinforcement agent-bath to a pressure which is greater than atmospheric pressure.

5. The method as defined in claim 1, further including the step of selected individual edge sections of the plate prior to immersion of the plate into the reinforcement agent-bath in order to prevent penetration of reinforcement agent into such selected edge sections.

* * * * *